United States Patent [19]

Adler

[11] 4,099,468

[45] Jul. 11, 1978

[54] LOCK FOR A HOPPER CAR OUTLET GATE

[75] Inventor: Franklin P. Adler, Michigan City, Ind.

[73] Assignee: Pullman Incorporated, Chicago, Ill.

[21] Appl. No.: 705,743

[22] Filed: Jul. 15, 1976

[51] Int. Cl.[2] ..... B61D 7/02

[52] U.S. Cl. ..... 105/310; 49/362; 292/DIG. 22; 292/238; 298/38

[58] Field of Search ..... 105/313, 310, 312, 308 R, 105/308 E, 308 P, 308 B, 282 R, 282 A, 282 P; 298/27, 38; 49/362, 220, 449; 292/238, DIG. 22, DIG. 46

[56] References Cited

U.S. PATENT DOCUMENTS

| | | | |
|---|---|---|---|
| 1,602,511 | 10/1926 | Tatum | 105/308 R |
| 2,145,173 | 1/1939 | Hankins | 105/282 R |
| 2,479,292 | 8/1949 | Batho | 105/313 X |
| 2,898,871 | 8/1959 | Dath | 105/313 X |
| 3,035,530 | 5/1962 | Meyers et al. | 105/313 X |
| 3,683,820 | 8/1972 | Floehr | 105/308 P X |
| 3,958,514 | 5/1976 | Akester et al. | 105/313 X |

*Primary Examiner*—Drayton E. Hoffman
*Assistant Examiner*—Donald W. Underwood
*Attorney, Agent, or Firm*—Thomas G. Anderson

[57] ABSTRACT

In a railway hopper car a sliding gate is provided at the discharge opening of the hopper for discharging materials therefrom. The gate comprises a frame supporting a sliding gate member movable from a closed position to an open position by means of a rack and pinion arrangement. The arrangement is actuated by an operating shaft which projects out from opposite ends of the gate and includes operating heads which are adapted to be engaged by a tool for rotating the shaft. A lock arrangement is provided for maintaining the sliding gate in a closed position and includes blocking elements which in the locked position of the gate are disposed over the operating heads to prevent the insertion of a tool unitl the locking mechanism is placed in an unlocked position.

7 Claims, 8 Drawing Figures

LOCK FOR A HOPPER CAR OUTLET GATE

BACKGROUND OF THE INVENTION

1. Field of the Invention

The present invention relates to a hopper gate of the sliding type for discharging material from a hopper by means of gravity. More specifically, the invention relates to an improved locking device for locking a sliding gate in a closed position including blocking means for preventing inadvertent operation of the gate when in said closed position.

2. Description of the Prior Art

The prior art includes many different types of gravity gates wherein material is discharged from a hopper after a sliding gate or door has been opened and placed to one side of the gate arrangement. Most of the conventional sliding gates are actuated by a rotating shaft having operating heads at opposite ends which upon the insertion of a power tool can be actuated to provide for rotation of a gear and rack mechanism which controls the sliding movement of the gate. Lock mechanisms have been provided in the art for maintaining the gates in a lock position and these generally include devices which provide for the insertion of a car seal when the gate is in a closed position. One of the patents of the prior art, 3,707,126, discloses an operating rod which includes stop members adapted to be positioned against a gate extension for maintaining the gate in the closed position. Closure mechanism of this type operates very well but all have a common problem. Quite frequently careless operators will attempt to open the gates without complete unlocking of the unlocking devices. They will insert a power tool in one or the other of the operating heads and attempt to move the gate, despite the locking stops. This will very likely destroy the rack and pinion arrangement and cause extensive maintenance problems. The present invention is an improvement over the prior art; i.e. in addition to locking the gate in a closed position it also prevents the insertion of a tool within the opening heads thereby preventing any attempted operation of the gate when it is in the locked position.

SUMMARY OF THE INVENTION

The gravity gate includes a frame which is supported on the hopper underneath the hopper opening. The gate includes a sliding door or gate member which is moved from a closed position to an open position to one side of the frame by a rack and pinion arrangement operated by means of a rotating operating shaft supported on the frame. The operating shaft is provided at its outer opposite ends with operating heads having socket constructions adapted to be engaged by a wrench or power tool for rotating the shaft and thus opening and closing the door or gate member. A locking arrangement or assembly is provided for maintaining the sliding gate in its closed position. The arrangement includes a locking shaft which is rotatably mounted in suitable bearings on the frame of the gate. The shaft includes stops which are adapted to engage extension of the gate to prevent opening movement thereof. Further the rod has provided thereon a car seal plate which is adapted to cooperate with stationary seal plates mounted on the gate for insertion of the car seal when the locking rod and gate is in the closed position. The locking assembly also comprises at opposite ends thereof arms which extend outwardly from the operating rod and which include blocking elements in the lock position of the rod being disposed over the operating heads in a manner blocking the possibility of any insertion of a tool or wrench into the operating head for operating the same. Thus the gate is locked in a closed position and the locking rod has provisions to prevent the insertion of any kind of operating tool while the assembly is positioned in said position. The insertion of a tool is prevented when the gate is securely locked thus eliminating problems presented by the gravity gate arrangements of the prior art.

DESCRIPTION OF THE PREFERRED EMBODIMENT

Figure 1:
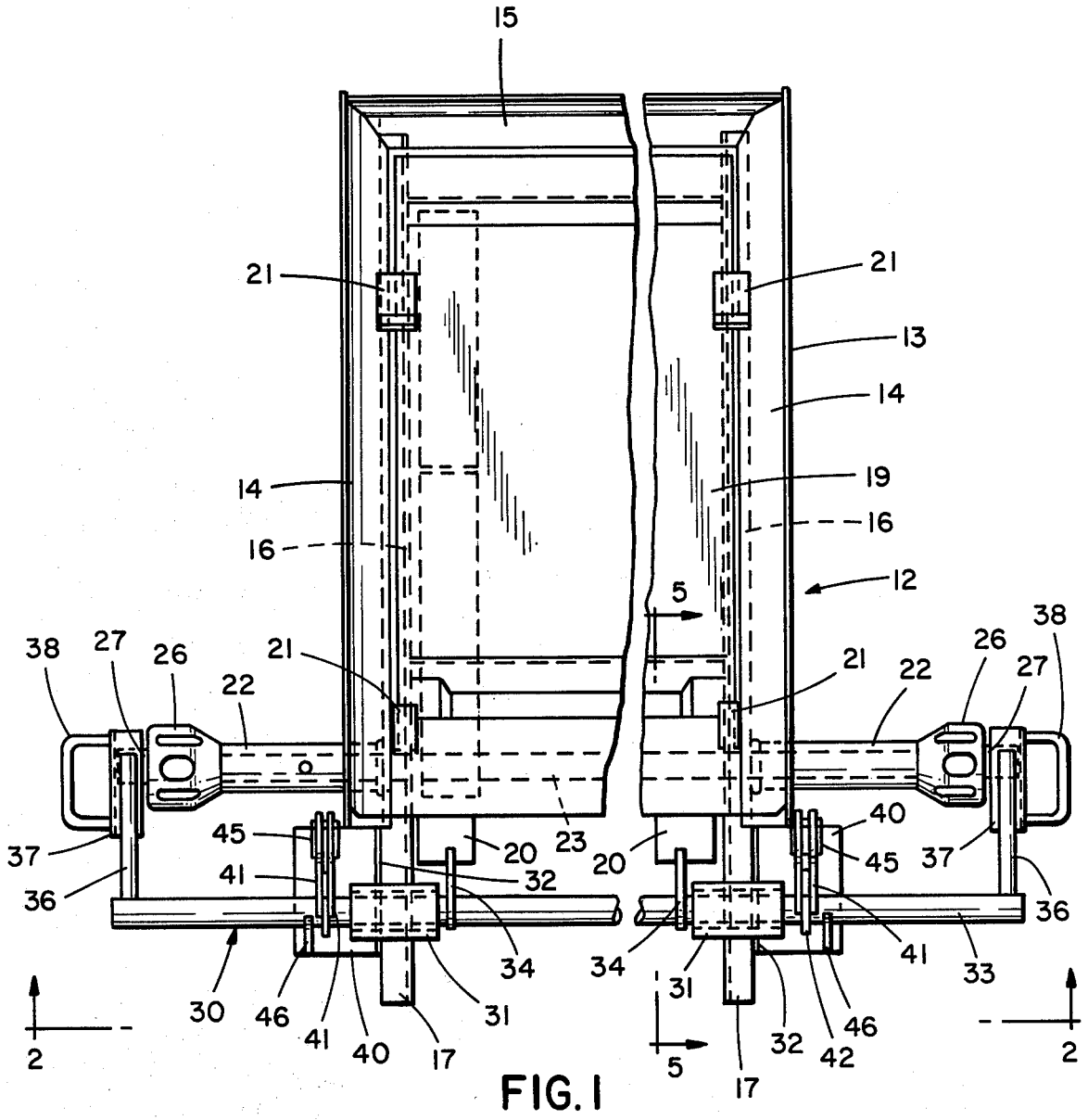
FIG. 1 is a plan view of a gravity gate having connected thereto an improved locking arrangement.
Figure 2:
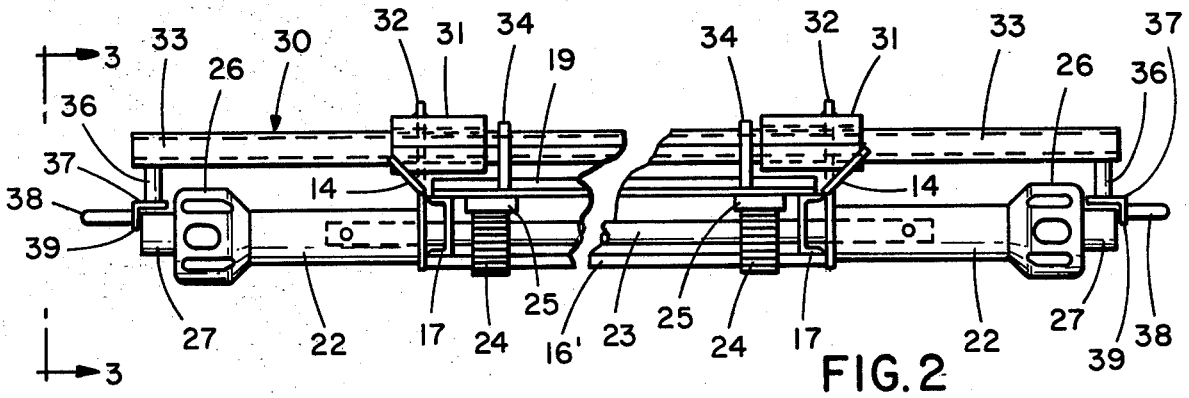
FIG. 2 is a rear view taken substantially along the line 2—2 of FIG. 1.
Figure 3:
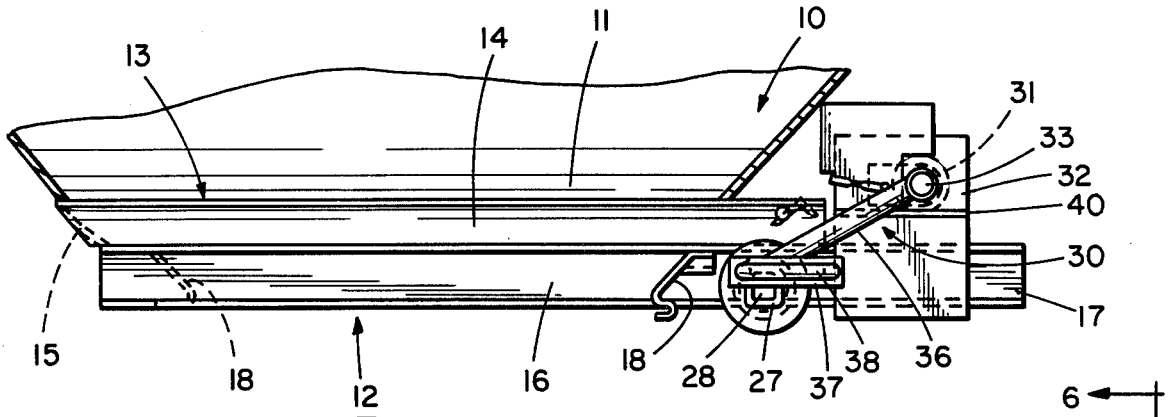
FIG. 3 is a side elevational view taken substantially along the line 3—3 of FIG. 2 also showing the gravity gate in its relation to a hopper structure.
Figure 4:
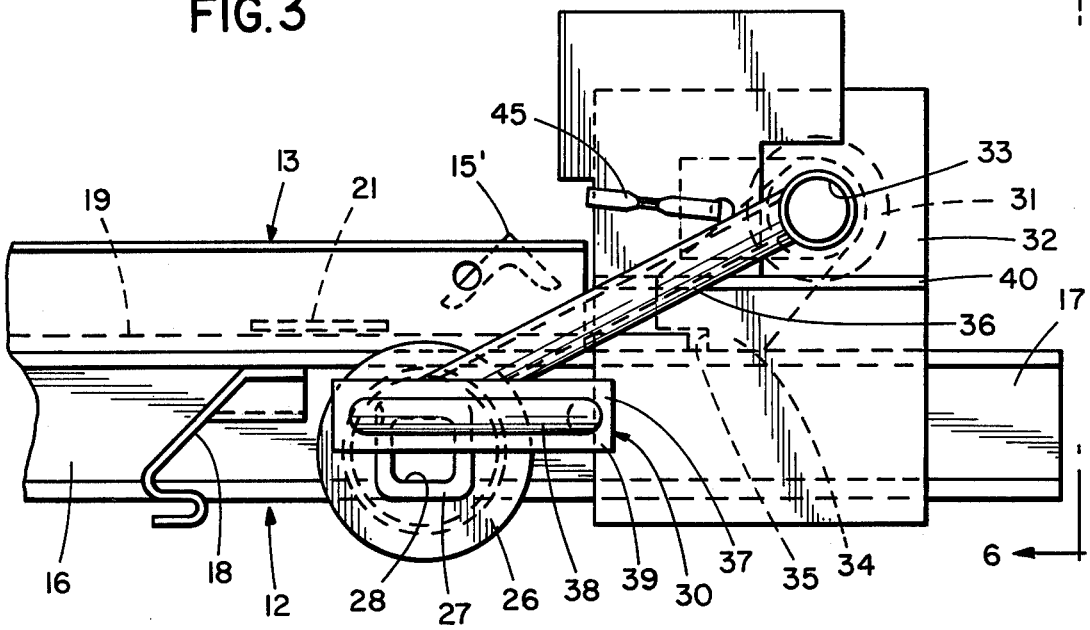
FIG. 4 is an enlarged side elevational view of the rear portion of a gravity gate showing in detail a locking assembly therefor.

FIG. 3 discloses a hopper 10 of a type which generally is supported on railway hopper cars and is provided with a discharge opening 11 for discharging materials through the lower end of the hopper and hopper car. A hopper discharge gate arrangement 12, of conventional type, includes a rectangular frame 13 comprised of side frame members 14 and a front frame member 15. The rear ends of the side frame members 14 are inter-connected by means of a raised angle 15', as shown in FIG. 4 and the frame members are suitably supported by a pair of lower channel-shaped frame members 16 interconnected by a transversely extending support member 16', as shown in FIG. 2. The lower channel frame members 16, as best shown in FIGS. 1, 3, and 4, are also provided with extensions 17 projecting rearwardly with respect to the frame member 14. As best shown in FIG. 3, transversely extending sloping lower discharge walls 18 are connected to the lower channel frame members 16 to direct material downwardly from the discharge opening 11 of the hopper 10. A sliding plate or gate member 19 is supported on the upper edges of the channel-shaped frame members 16 and is adapted to be moved from a closed position blocking the discharge opening 11 to an open position adjacent one side thereof. The sliding gate 19 also includes a pair of gate extensions 20 projecting rearwardly therefrom. The gate 19 is held in position against upward movement by means of sliding stops 21 secured to the side frame members 14.

An operating or actuating shaft 22 is formed of two tubular members inter-connected by a smaller diameter connecting shaft 23. The shafts 22 and 23 are supported for rotation on the extensions 17 of the channel-shaped member 16 and rotation thereof provides for rotation of pinions 24 engageable with racks 25 in a conventional manner. Thus, the rotation of the shaft 22 provides for movement of the gate 19 between open and closed positions. Such rotation of the shafts 22 is provided by means of operating heads 26 positioned at the outer ends of the shaft 22. The operating heads 26, as best shown in FIGS. 2 and 4 include socket extensions 27 having tubular sockets provided therein which are capable of receiving a power wrench or hand operated wrench for turning the shaft 22 during operation.

Figure 5:
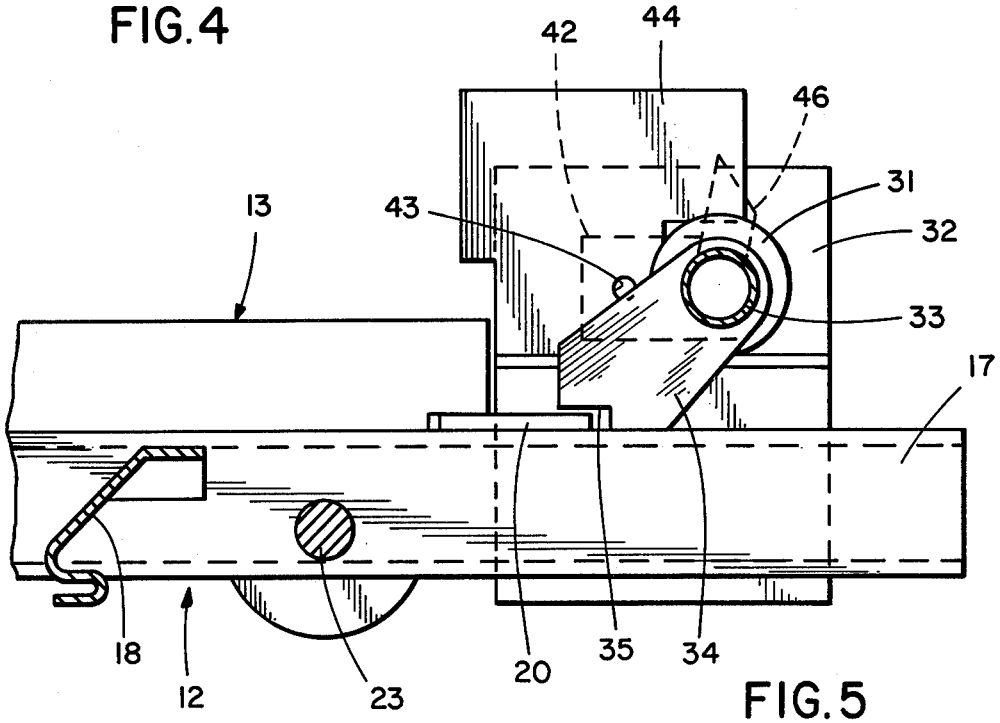
FIG. 5 is a cross-sectional view taken substantially along the line 5—5 of FIG. 1.

The aforementioned description of the operating gate describes a substantially conventional design of the prior art. The present invention relates to a lock assembly generally designated at 30 which is operative to maintain the sliding gate or door in a locked position during non-use and which is operative to readily unlock when the gate is to be operated for discharge. The lock assembly comprises a pair of bearing sleeves 31 each supported on a vertical plate 32 rigidly supported on the extension 17 of the channel-shaped members 16. A locking shaft 33 of tubular construction is rotatably supported on the sleeves 31. The locking shaft as best shown in FIGS. 1, 5, and 8, is provided with locking plates 34 which are adapted to be moved into locking engagement with respect to gate extensions 20 to prevent opening movement of the gate. This is achieved by an undercut 35 provided at the forward end of each locking plate 34 which as best shown in FIG. 5 operates to limit rearward movement of the gate into an open position. The shaft 33 is provided at its outer ends with a pair of arms 36 extending perpendicular to the shaft. The arms 36 have connected thereto angle-shaped blocking elements 37 which as best shown in FIG. 4 are each disposed over the sockets 28 of the socket extension 27 in locked or blocking position preventing the insertion of any kind of operating tool or wrench. This blocking arrangement is provided by the downwardly extending flange 39, as best shown in FIG. 2, of the angle-shaped blocking element 37. Each of the blocking elements 37 has connected thereto and outwardly projecting therefrom a handle 38. The operator may grasp the handle for moving the arms 36 to their raised or unlocked position as best shown in FIG. 7.

Figure 6:
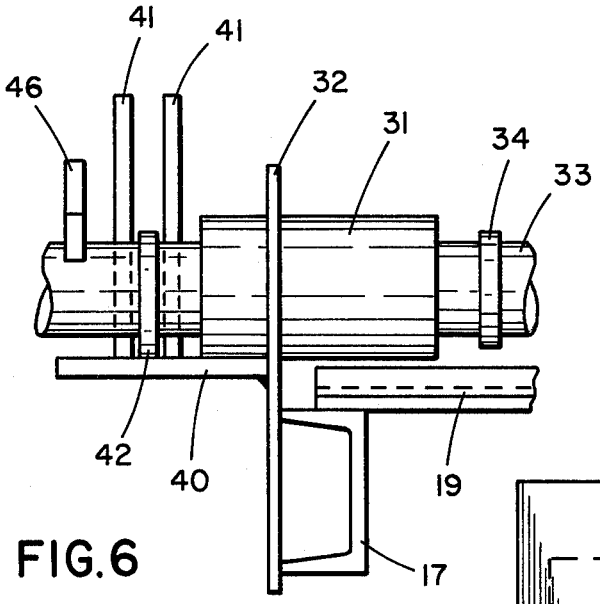
FIG. 6 is a partial rear elevational view taken substantially along the line 6—6 of FIG. 4.

As best shown in FIG. 6, each of the vertical plates 32 which supports the sleeves 31 also is provided with a laterally extending base plate 40 projecting laterally outwardly with respect thereto. Each base plate 40 supports a pair of spaced car seal support plates 41. The support plates 41 are cut-out as indicated at 41', FIGS. 7 and 8, to provide room for the extension of the locking shaft 33. Each of the car seal support plates is provided with car seal openings 43 in registry. A car seal locking plate 42 is connected to the shaft 33 for rotation therewith and includes a car seal opening 44. In the locked position the opening 44 is in registry with the openings 43 of the support plates and a car seal 45 may be inserted through the openings for securing the arrangement in a locked position. Both car seals 45 are shown in locked position in FIG. 1. As best shown in FIGS. 6, 7, and 8, a pair of laterally spaced over-center stops 46 are rigidly connected to the shaft 33 and are adapted to support the locking arrangement 30 in an over-center release position as shown in FIGS. 7 and 8.

Operation

Figure 7:
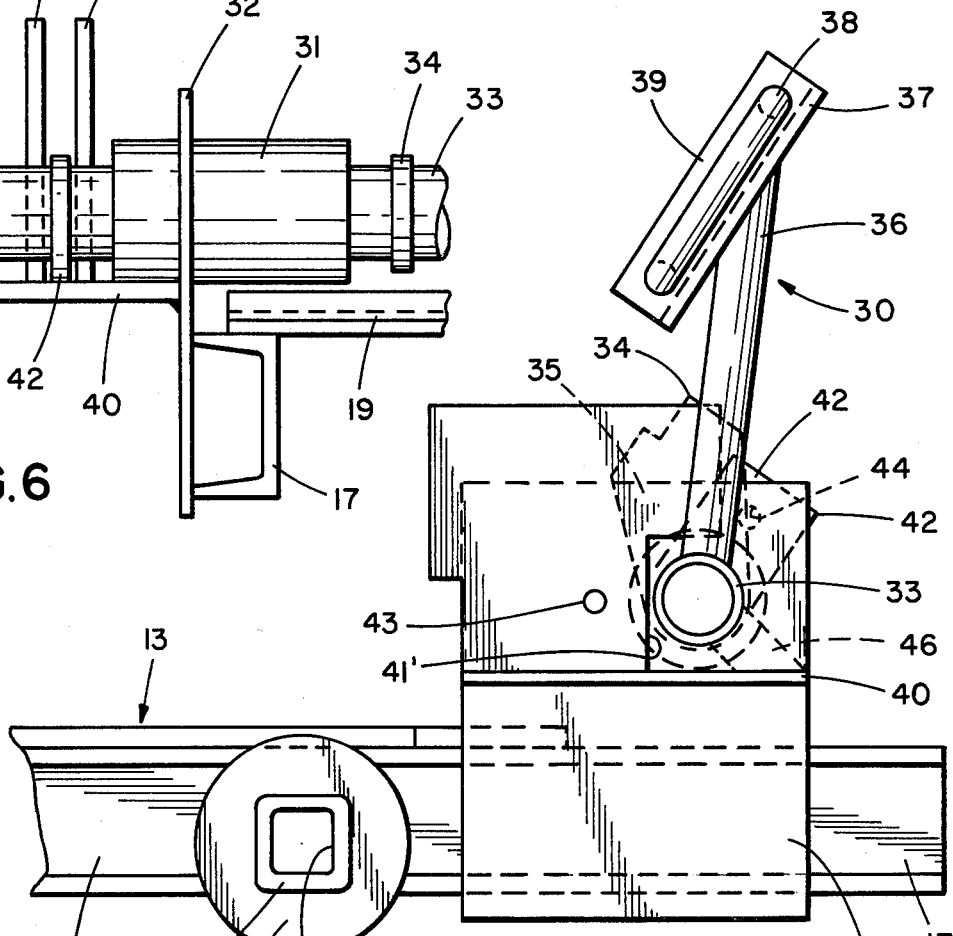
FIG. 7 is a view similar to FIG. 4 showing a locking mechanism in an unlocked position.
Figure 8:
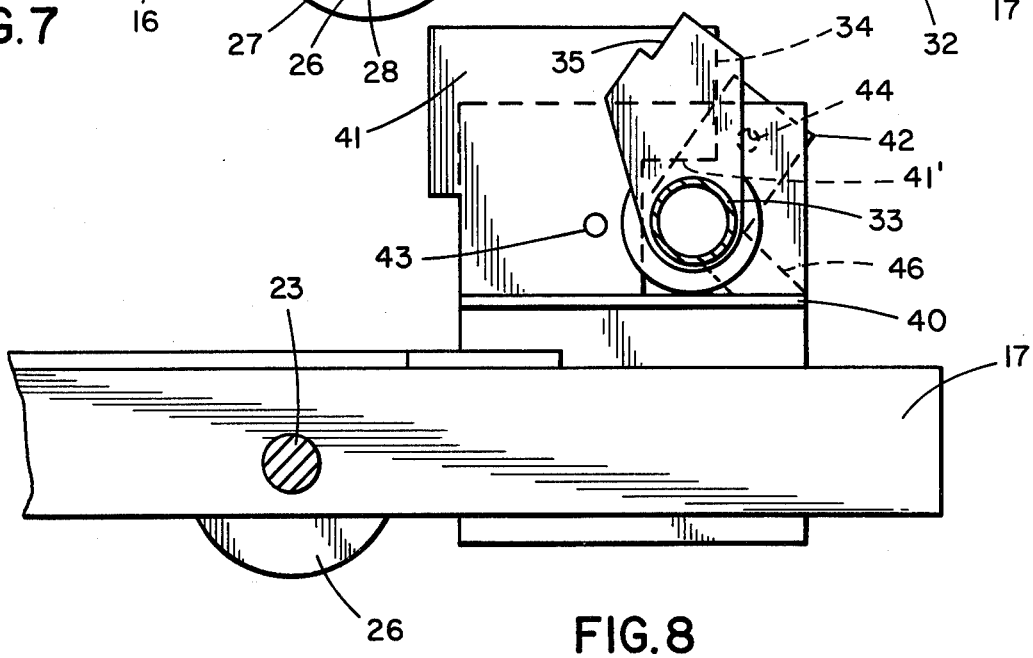
FIG. 8 is a view similar to FIG. 5 showing an unlocked position of the locking mechanism.

In the unlocked position of the locking arrangement shown in FIG. 7, the gravity gate is operated in a conventional manner. The operator is able to insert a hand or power wrench into the socket 28 whereupon the gate is moved from the closed position shown in FIGS. 1 and 2 to an open position to the rear of one side of the discharge openings. To again close the gate the power wrench again is operated in reverse and conventional closing occurs. Once the gate is in the closed position the operator grasps the handle on either side of the gate and moves it from the position shown in FIG. 7 downwardly into the position shown in FIG. 4. In this position the flange 39 of the angle blocking member 37 is disposed over the socket 28 to block any access thereto. The operator now inserts the car seals 45 within the car seal plates on opposite sides of the frame and the locking mechanism is positioned to prevent opening of the gate since the locking plates are in the positions shown in FIGS. 1 and 5. As previously indicated locking mechanisms in the prior art have been effective to prevent opening of the gates in transit. However, they have not been effective to prevent human error wherein operators have attempted to open the gates without removing the locking mechanism therefrom. Obviously the insertion of a power wrench into the socket of the operating shaft while the locking mechanism is closed can only result in the destruction of the rack and pinion arrangement or cause other breakage of serious nature. In the present arrangement the locking mechanism is not only effective to lock the gate against opening in transit but also is effective to prevent the accidental or intentional opening of the gate without first being certain that the locking mechanism has been disengaged.

When it is again desired to open the gate the operator grasps the handle 38 of either side of the gate and lifts upwardly causing rotation of the arms 36 and the locking arrangement then is positioned in the position shown in FIG. 7. The over-center stops 46 maintain this position until it is again desired to place the locking mechanism into locking operation. In the position shown in FIG. 7, the locking arrangement may be moved to a locked position in the event the railway hopper car is impacted or moved since any slight movement or bump will cause the locking mechanism to be moved from the position shown in FIG. 7 down to its locked position, the same occurring by gravity. Thus, if the operator fails to move the lock in position to the locked position after unloading of the car the same occurs automatically when the car is placed in motion. Thus the gate again is locked and while in an inadvertent situation of this type the car seals are not engaged, nevertheless the locking device is operative and again when the car moves to its destination the operator must raise the locking assembly in order to provide for insertion of his power wrench into the socket for operating the gate. Under normal operation when the operator moves the locking assembly to the raised position severing of the car seal is immediately effected by virtue of the shearing relationship of the car seal support plates 41 and car seal locking plate 42. Thus, quick opening of the gate and unlocking thereof is assured.

The foregoing description and drawings merely explain and illustrate the invention and the invention is not limited thereto, except insofar as the appended claims are so limited, as those skilled in the art who have the disclosure before them will be able to make modifications and variations therein without departing from the scope of the invention.

What is claimed is:

1. A discharge gate for a hopper having a discharge opening, said gate including a frame attached to said hopper at said opening, a horizontally movable closure gate slidingly supported on said frame for movement from a closed position beneath said opening to an open position to one side of said opening, an actuating shaft rotatably mounted on said frame, actuating means on said gate operated by said actuating shaft for slidingly moving the gate between said positions, said actuating shaft having at opposite ends thereof operating heads adapted to receive external operating means for rotating said shaft, the improvement comprising;

a lock assembly for locking said sliding gate in a closed position including, a locking shaft, means rotatably supporting said locking shaft in laterally spaced relation on said frame, locking plate means supported on said locking shaft in a locking position engaging and blocking opening movement of said gate, and means on said locking shaft in the locking position blocking operating means access to said operating head, said blocking means being movable with said locking shaft and said locking plate means to an unlock position whereupon operating access to said operating head is achieved, said locking shaft extending substantially parallel and coextensive with said actuating shaft, said blocking means including arms projecting in U-shaped configuration from said locking shaft and being rotatable with said locking plate means to an unlock position, said arms including handle means adapted to be grasped by an operator on either side of said gate for moving said locking shaft between lock and open positions, said handle means being connected to said blocking means and projecting outwardly with respect thereto.

2. The invention in accordance with claim 1, said operating heads having socket means for receiving external operating means of a wrench type, said blocking means in the locked position preventing access to said socket means.

3. The invention in accordance with claim 2, said blocking means comprising a member having at least a portion thereof projecting over said socket.

4. The invention in accordance with claim 1, said locking shaft being rotatable to move said blocking means in an arcuate path to an over-center unlock position, and means on said locking shaft and supported on said frame for maintaining said blocking means in said over-center position.

5. The invention in accordance with claim 1, including a car seal support plate means supported on said frame, a car seal locking plate supported on said locking shaft for rotation therewith, said seal plates each having an opening with said openings being in aligned relation in the locked position of said locking shaft for receiving a car seal.

6. The invention in accordance with claim 5, said car seal support plate means comprising a pair of plates positioned on opposite adjacent sides of said car seal plate, whereby during rotating movement of said locking shaft to an unlock position said car seal is severed.

7. The invention in accordance with claim 5, wherein a set of car seal support plate means and car seal locking plate is provided adjacent opposite sides of said frame on said locking shaft.

* * * * *